United States Patent [19]

Inagaki

[11] Patent Number: 5,059,752

[45] Date of Patent: Oct. 22, 1991

[54] VACUUM SWITCH

[75] Inventor: Koichi Inagaki, Hyogo, Japan

[73] Assignee: Mitsubishi Denki Kabushiki Kaisha, Tokyo, Japan

[21] Appl. No.: 410,269

[22] Filed: Sep. 21, 1989

[30] Foreign Application Priority Data

Nov. 24, 1988 [JP] Japan ..... 63-296887

[51] Int. Cl.[5] ..... H01H 33/66

[52] U.S. Cl. ..... 200/144 B

[58] Field of Search ..... 200/144 B, 144 A, 265, 200/266, 267

[56] References Cited

U.S. PATENT DOCUMENTS

| | | | |
|---|---|---|---|
| 3,462,572 | 8/1969 | Sofianek | 200/144 B |
| 3,502,465 | 3/1970 | Nakajima | 200/144 B X |
| 4,210,790 | 7/1980 | Kurosawa et al. | 200/144 B |

FOREIGN PATENT DOCUMENTS 36-18113 10/1961 Japan .

*Primary Examiner*—J. R. Scott

*Attorney, Agent, or Firm*—Rothwell, Figg, Ernst & Kurz

[57] ABSTRACT

A vacuum switch comprises a highly conductive member provided on a back surface of a main electrode. The highly conductive member prevents an arc formed upon breaking a large current from becoming locally concentrated or stagnated, and promotes rapid and smooth movement of the arc from the main electrode to an auxiliary electrode. Marked enhancement and stabilization of the vacuum switch tube performance in breaking a large current, as well as enabling a smaller construction, are thereby realized. The main electrode, auxiliary electrode, and highly conductive member are formed of metal alloy materials selected so that the conductivities $\sigma_a$, $\sigma_b$, $\sigma_h$ of the main and auxiliary electrodes and the highly conductive member respectively satisfy the relationship $\sigma_a < \sigma_b < \sigma_h$.

7 Claims, 4 Drawing Sheets

VACUUM SWITCH

The main electrode, auxiliary electrode, and highly conductive member are formed of metal alloy materials selected so that the conductivities $\sigma_a$, $\sigma_b$, $\sigma_h$ of the main and auxiliary electrodes and the highly conductive member respectively satisfy the relationship $\sigma_a<\sigma_b<\sigma_h$.

BACKGROUND OF THE INVENTION

1. Field of the Invention

This invention relates to a vacuum switch used for switching a large electric current.

2. Description of the Prior Art

FIG. 1 is a sectional view of a conventional vacuum switch, as disclosed in Japanese Patent Publication No. 45-29935 (1970), and a sectional view taken along line A—A' of FIG. 1 is shown in FIG. 2. In the figures, a vacuum vessel 1 is formed to maintain therein a high vacuum pressure of $10^{-4}$ Torr or below. A stationary electrode rod 5 is disposed with one end portion fixed to a stationary-side end plate 2 of the vessel 1. A movable electrode rod 6 is fixed to one end of a bellows 4, and is passed through a movable-side end plate 3, to which the other end of the bellows 4 is fixed, so that the movable electrode rod 6 is movable vertically relative to the end plate 3. The stationary electrode rod 5 and the movable electrode rod 6 are provided respectively with a stationary electrode 7 and a movable electrode 8, each of which comprises a main electrode 7*a*, 8*a* provided at a central portion thereof and an auxiliary electrode 7*b*, 8*b* provided at the periphery of the central portion and connected to the respective electrode rods 5, 6. The main electrodes 7*a* and 8*a* are each provided with a recessed portion 7*c*, 8*c* at a central portion thereof and an annular portion 7*d*, 8*d* at the peripheral portion thereof. The auxiliary electrodes 7*b* and 8*b* are provided with spiral grooves 7*e* and 8*e*, respectively. For adsorbing a metal vapor emitted from each of the electrodes, a shield plate 9 is provided.

The conventional vacuum switch mentioned above operates as follows. The vacuum switch operates by moving, the movable electrode rod 6 upward to bring the main electrodes 7*a*, 8*a* into contact with each other at the annular portions 7*d*, 8*d*. Upon contact a current flows through the path formed by the stationary electrode rod 5-auxiliary electrode 7*b*-main electrode 7*a*-main electrode 8*a*-auxiliary electrode 8*b*-movable electrode rod 6. To break the vacuum switch, on the other hand, the movable electrode rod 6 is moved downward to separate the main electrode 8*a* from the main electrode 7*a*, thereby breaking the current. In this case, when the magnitude of the current flowing is of the order of the load current, separation of the annular portion 8*d* from the annular portion 7*d* completes the break of the flowing current in that region. However when the flowing current is a heavy current, as in the case of a shortcircuit or the like, the separation of the annular portion 8*d* from the annular portion 7*d* is accompanied by an arc produced therebetween. The arc moves outward with respect to the center axis of the electrodes due to the effect of a magnetic field developed by an external wiring or the like. Upon reaching the auxiliary electrodes 7*b*, 8*b*, the arc is given a rotating force by the spiral grooves 7*e*, 8*e*, and is brought into a rotational motion around the center axis while moving further outward. This process prevents the arc from stagnating locally to damage the electrodes or to generate a metal vapor.

The main electrodes 7*a*, 8*a*, which make contact with each other to serve as a current-passing portion when the vacuum switch is operated, form an arc-extinguishing portion when the electrodes are separated from one another and the magnitude of the current is of the order of the load current. Therefore, a material requiring a small tripping force against welding thereof and having a small chopping current value is selected for the main electrodes 7*a*, 8*a*. For the auxiliary electrodes 7*b*, 8*b*, on the other hand, a material is selected which is capable of breaking a large current and which has superior withstand voltage performance. Furthermore, the main electrodes 7*a*, 8*a*, auxiliary electrodes 7*b*, 8*b*, stationary electrode rod 5 and movable electrode rod 6 are joined to each other generally by brazing using a Cu-Ag brazing filler metal in a hydrogen atmosphere or in a vacuum.

Various problems have resulted from the vacuum switch constructed as mentioned above. For example, where the material constituting the main electrodes 7*a*, 8*a* is quite different from the material constituting the auxiliary electrodes 7*b*, 8*b*, as in the case where the main electrodes 7*a*, 8*a* are formed of a material containing a large amount of a low melting point metal whereas the auxiliary electrodes 7*b*, 8*b* are formed of a high withstand voltage material, a metal vapor is likely to be emitted from the low melting point metal at the time of breaking a heavy current, making it difficult for the arc to move to the auxiliary electrodes 7*b*, 8*b*. As a result, the arc stagnates at the main electrodes 7*a*, 8*a*, thereby causing heavy damage to the electrodes. It is therefore impossible to obtain a stable break performance for large currents.

SUMMARY OF THE INVENTION

It is an object of this invention to overcome the above-mentioned difficulties by providing, a vacuum switch which has an electrode structure ensuring stable break of large currents and is small in size and economical.

To attain the above object, a vacuum switch according to this invention comprises a highly conductive member on a non-opposed surface of each one of a stationary electrode and a movable electrode opposed to each other, namely, on either or both of back surfaces of a main electrode and an auxiliary electrode, at least on the back surface of the main electrode, of each one of the stationary and movable electrodes. Furthermore in the vacuum switch according to the instant invention, the electric conductivities $\sigma_a$, $\sigma_b$ and $\sigma_h$ of the main electrode, auxiliary electrode and highly conductive member are so selected that $\sigma_a<\sigma_b<\sigma_h$. These features, together with an improvement in electrode shape, prevent the local concentration or stagnation of an arc formed upon the break of an electric current, thereby realizing a stable performance in breaking a large current.

Other objects and effects of the present invention will become apparent from the following detailed description of the preferred embodiments of this invention, referred to in the accompanying drawings.

DETAILED DESCRIPTION OF THE PREFERRED EMBODIMENTS

Figure 1:
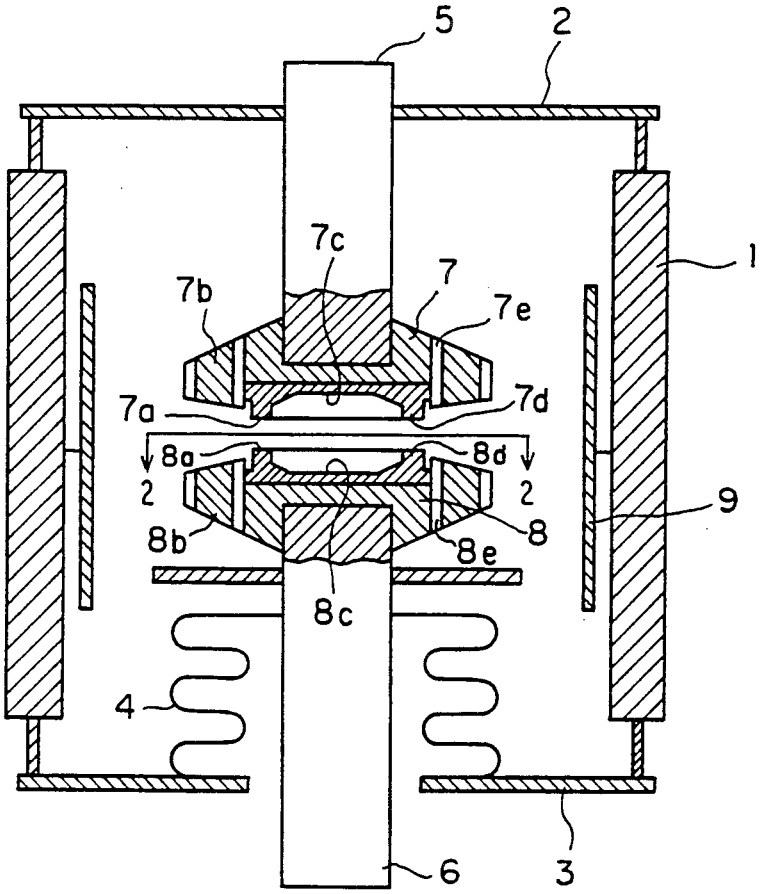
FIG. 1 (PRIOR ART)
FIG. 1 is a sectional side view of a vacuum switch according to the prior art.
Figure 2:
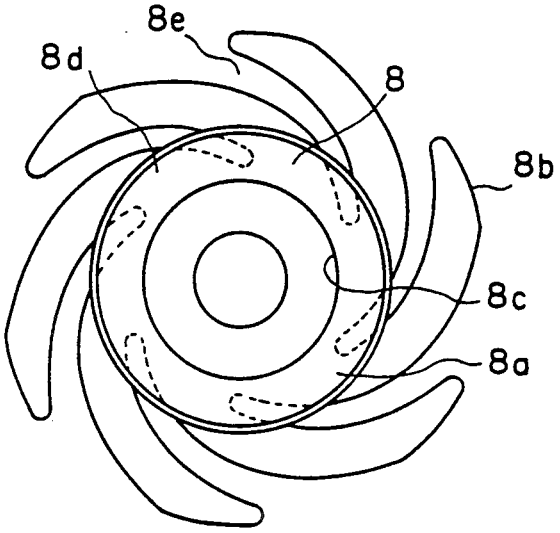
FIG. 2 (PRIOR ART)
FIG. 2 is a sectional plan view taken along line 2—2 of FIG. 1.
Figure 3:
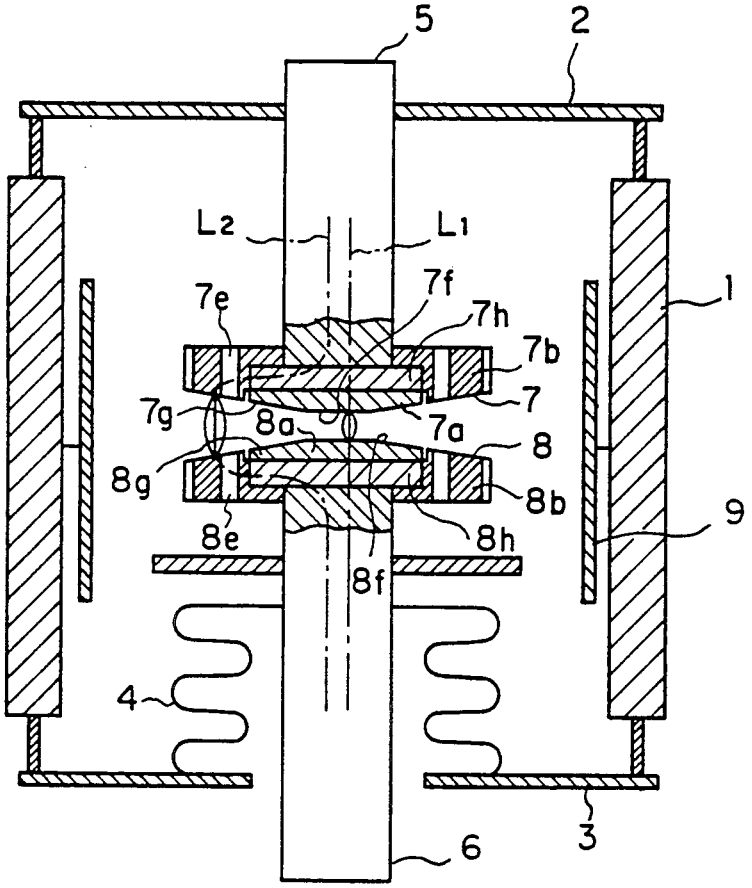
FIG. 3 is a sectional side view of a vacuum switch according to one embodiment of this invention.
Figure 4:
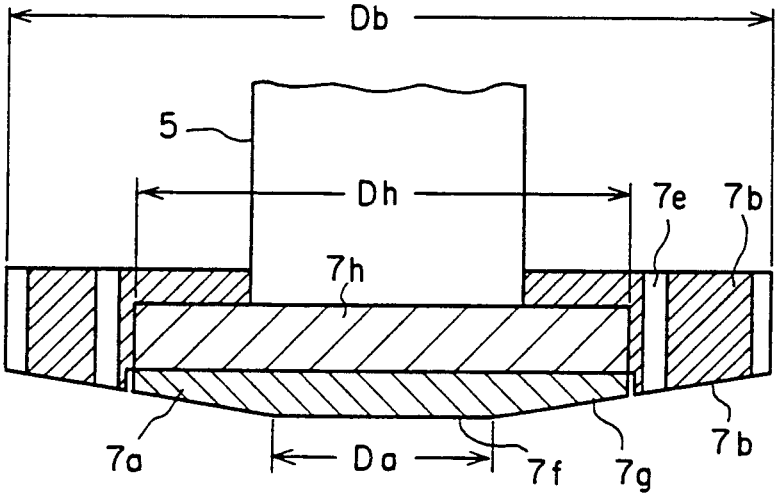
FIG. 4 is a sectional side view of a stationary electrode shown in FIG. 3.

A preferred embodiment of the present invention will be described hereinafter with reference to FIGS. 3 and 4. In FIGS. 3 and 4, the components or portions which are the same as or equivalent to the corresponding components or portions in FIGS. 1 and 2 are denoted by the same reference signs as in FIGS. 1 and 2. Accordingly, the explanation of those components or portions will be omitted. In FIGS. 3 and 4, mutually opposed surfaces of main electrodes 7*a*, 8*a* are each provided with a flat portion 7*f*, 8*f* having a diameter Da at a central portion thereof and are provided with a taper portion 7*g*, 8*g* at a peripheral portion thereof. On back surfaces of the main electrodes 7*a*, 8*a* are provided highly conductive members of a diameter Dh, which are formed of copper or the like and are connected to a stationary electrode rod 5 and to a movable electrode rod 6, respectively.

Db denotes the diameter of auxiliary electrodes 7*b*, 8*b*a $L_1$ and $L_2$ denotes the paths of arc currents flowing through the main electrodes 7*a*, 8*a* and the auxiliary electrodes 7*b*, 8*b*, respectively. The electric conductivities $\sigma_a$, $\sigma_b$ and $\sigma_h$ of the main electrodes 7*a*, 8*a*, auxiliary electrodes 7*b*, 8*b* and highly conductive members 7*h*, 8*h* are so selected that $\sigma_a<\sigma_b<\sigma_h$.

In a preferred embodiment shown in FIGS. 3 and 4 Cu-20-Cr-Bi is used as a material for the main electrodes 7*a*, 8*a*, whereas Cu-(10-60)Cr or Cu-20Cr is used as a material for the auxiliary electrodes 7*b*, 8*b*, and 99.9Cu is used as a material for the highly conductive members 7*h*, 8*h*. The relative values of the conductivities of the materials are roughly in the ratio $\sigma_a:\sigma_b:\sigma_h\approx 0.3:0.7:1$.

When a material containing at least 10% of a low melting point metal, such as Bi or Te, is used for the main electrodes 7*a*, 8*a*, a mixed powder of the electrode material may be compression-molded onto a copper base, followed by integral forming. The integral forming process can be performed as described in Japanese Patent Application Laid-Open (KOKAI) No. 59-3822 (1984). It is thereby possible to obtain a stock in which the electrode material and the highly conductive member 7*h*, 8*h* comprised of copper are combined with each other to form a body through a thermal reaction, and the stock is capable of being used after having mechanically processed. When the above-mentioned electrode material is used for the auxiliary electrodes 7*b*, 8*b*, it is possible to obtain a smaller vacuum switch capable of breaking a large current, with a higher withstand voltage and a lower chopping current value. This is distinguished from the case where the auxiliary electrodes 7*b*, 8*b* themselves are formed of copper to constitute the highly conductive members.

The operation of the above-mentioned vacuum switch tube will be explained hereinafter. To make the vacuum switch, the movable electrode rod 6 is moved upward to bring the main electrodes 7*a*, 8*a* into contact with each other at the flat portions 7*f*, 8*f* thereof. Upon contact the current path $L_1$ is formed by the stationary electrode rod 5-highly conductive member 7*h*-main electrode 7*a*-main electrode 8*a*-highly conductive member 8*h*-movable electrode rod 6.

To break a current of the order of the load current, the movable electrode rod 6 is moved downward to separate the flat portions 7*f*, 8*f* from each other, whereby the breaking is completed in that region. When a material containing a large amount of the low melting point metal mentioned above is used for the main electrodes 7*a*, 8*a*, it is possible to obtain a low chopping current value of not more than 1 A.

When breaking a large current, as for example in the case of a shortcircuit, separation of the flat portions 7*f*, 8*f* from each other causes formation of an arc at that portion, and the arc is moved outward by an electromagnetic force generated by an external wiring or the like. The movement takes place smoothly between the main electrodes 7*a*, 8*a* formed of the same material, and the arc is further moved rapidly from the flat portions 7*f*, 8*f* to the tapered portions 7*g*, 8*g*. Because the mutually opposed surfaces of the main electrodes 7*a*, 8*a* in this embodiment comprise the flat portions 7*f*, 8*f* and the tapered portions 7*g*, 8*g* extending from the flat portions, there is no possibility of the concentration or stagnation of the arc, which would occur in the conventional vacuum switch tube shown in FIGS. 1 and 2 at stepped portions formed by the recessed portions 7*c*, 8*c* or the annular portions 7*d*, 8*d* of the main electrodes. Thus, in this embodiment, the movement of the arc takes place rapidly and smoothly.

According to a further aspect of the present invention, As the arc moved to the tapered parts 7*g*, 8*g* is further moved smoothly without stagnating at the auxiliary electrodes 7*b*, 8*b* formed of a material different from the material of the main electrodes 7*a*, 8*a*. The reason is as follows. Because the conductivities $\sigma_a$, $\sigma_b$ and $\sigma_h$ of the main electrodes 7*a*, 8*a*, auxiliary electrodes 7*b*, 8*b* and highly conductive members 7*h*, 8*h* are so selected as to satisfy the relationship $\sigma_a<\sigma_b<\sigma_h$, the current flows through the path of the stationary electrode rod 5-highly conductive member 7*h*-auxiliary electrode 7*b*-auxiliary electrode 8*b*-highly conductive member 8*h*-movable electrode rod 6 as indicated by the current path $L_2$. The movement of the arc from the tapered portions 7*g*, 8*g* to the auxiliary electrodes 7*b*, 8*b* is therefore effected smoothly through the highly conductive members 7*h*, 8*h*.

Figure 5:
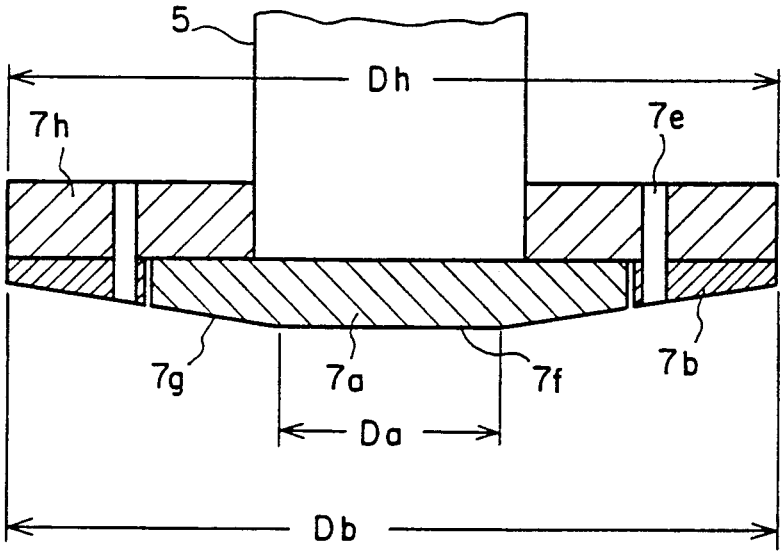
FIG. 5 is a sectional side view of a stationary electrode in a vacuum switch according to another embodiment of the invention.
Figure 6:
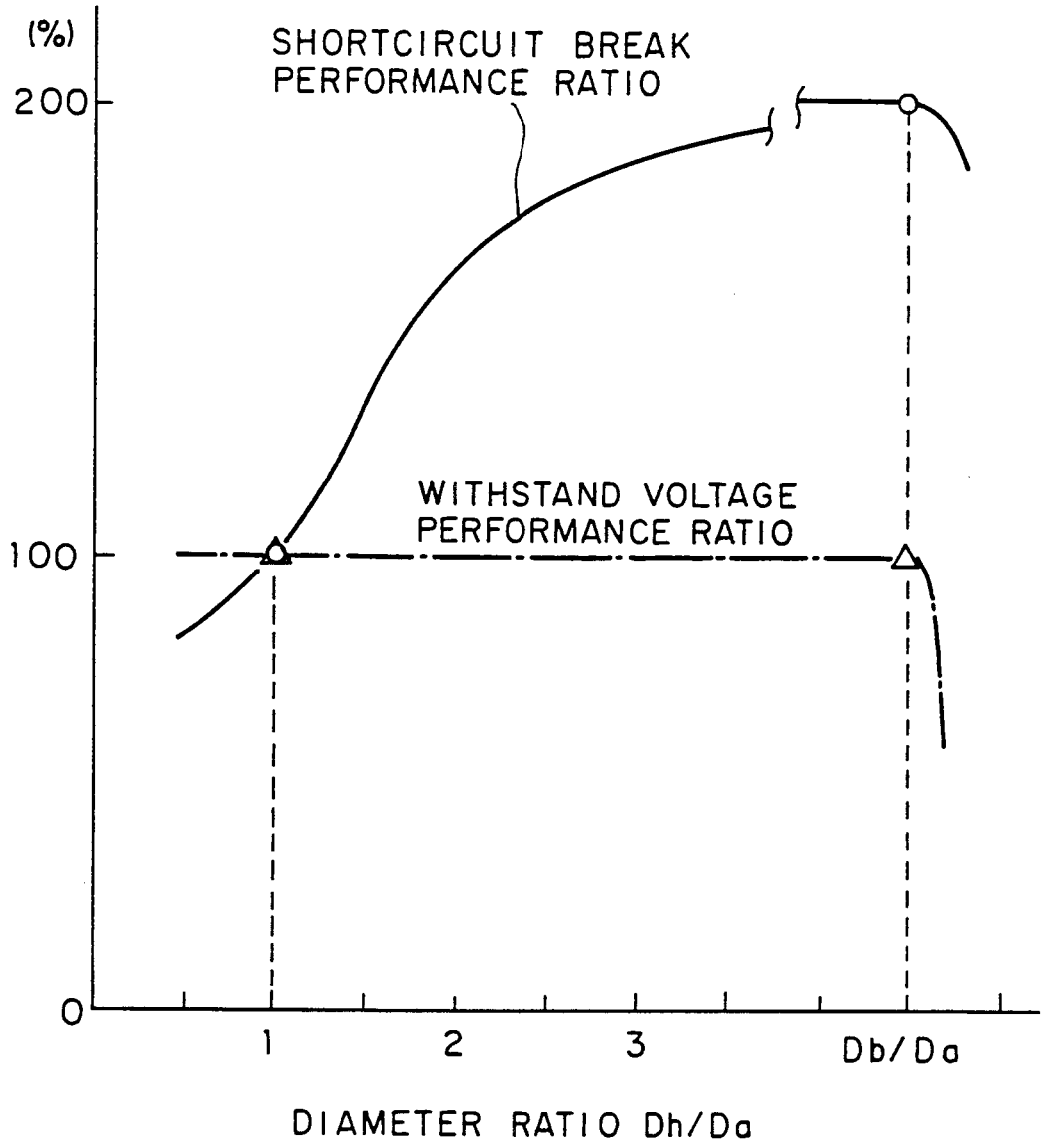
FIG. 6 is a characteristic diagram showing the performance of the vacuum switch shown in FIG. 5.

Though in the above embodiment the highly conductive members 7*h*, 8*h* are provided on only the back surfaces of the main electrodes 7*a*, 8*a*, the highly conductive members may be provided over the back surfaces of both the main electrodes 7*a*, 8*a* and the auxiliary electrodes 7*b*, 8*b*, as shown in FIG. 5, in which case the performance in breaking a large current is further enhanced. Namely, in the embodiment shown in FIG. 4, Da<Dh<Db, whereas in the embodiment shown in FIG. 5, Da<Dh=Db. The higher the diameter ratio Dh/Da, the easier the movement of the arc from the current path $L_1$ to the current path $L_2$. The maximum value of the diameter ratio Dh/Da is limited to Db/Da, for the following reason. The material of the auxiliary electrodes 7*b*, 8*b* comprising the Cu-Cr alloy as mentioned above is superior, in shortcircuit break performance and withstand voltage performance, to the material of the highly conductive members 7*h*, 8*h* comprising Cu formed of this Cu-Cr alloy. outer peripheral portions of the opposed surfaces of the auxiliary electrodes 7b, 8b should be formed of the FIG. 6 is a characteristic diagram showing the shortcircuit cutoff performance ratio and withstand voltage performance ratio, for the case where the materials of the above-mentioned compositions are used for the electrodes. In the diagram, the shortcircuit break performance ratio is indicated by taking the value at Dh/Da=1 as 100%, and the withstand voltage performance ratio is indicated by taking the value at Dh/Da=Db/Da as 100%. It is clearly seen from the diagram that the effect of this invention is displayed when the ratio Dh/Da is in the range $1 \leqq$ Dh/Da $\leqq$ Db/Da.

The compositions of the materials for the three portions, i.e., main electrode 7a, 8a, auxiliary electrode 7b, 8b and highly conductive member 7b, 8b, are not limited to the above-mentioned materials. The materials for the three portions may be, for instance, $CuCrBi_2O_3$ CuCr and Cu, respectively, or AgWC, CuCr and Cu, respectively, or CuC, CuCr and Cu, respectively. With such combinations of materials, the same effect as in the above embodiment can be obtained.

Moreover, the ratio of the conductivities $\sigma_a$, $\sigma_b$ and $\sigma_h$ of the above-mentioned three portions is not limited to the above-mentioned numerical value, insofar as the conductivities $\sigma_a$, $\sigma_b$ and $\sigma_h$ satisfy the relationship $\sigma_a < \sigma_b < \sigma_h$.

What is claimed is:

1. A vacuum switch, comprising:

a vacuum vessel enclosing an evacuated space;

a stationary electrode and a movable electrode located within said evacuated space, each of said stationary and movable electrodes including a main electrode and an auxiliary electrode disposed around the periphery of said main electrode, said stationary and movable electrodes being relatively movable into and out of contact with each other to switch a flow of current on and off;

stationary support means for supporting said stationary electrode within said vacuum vessel;

movable support means for supporting said movable electrode within said vacuum vessel;

a highly conductive member provided in contact with said stationary support means and said main electrode of said stationary electrode; and a highly conductive member provided in contact with said movable support means and said main electrode of said movable electrode;

wherein the conductivities $\sigma_a$, $\sigma_b$, $\sigma_h$ of said main electrode, auxiliary electrode, and highly conductive member of said stationary and movable electrodes satisfy the relationship $\sigma_a < \sigma_b < \sigma_h$, so as to cause arc current to flow from said support means to said auxiliary electrodes through said highly conductive members, bypassing said main electrodes.

2. A vacuum switch as set forth in claim 1, wherein the diameter of said highly conductive member is smaller than the diameter of said auxiliary electrode.

3. A vacuum switch as set forth in claim 1, wherein the diameter of said highly conductive member is equal to the diameter of said auxiliary electrode.

4. A vacuum switch as set forth in any one of claims 1, 2, or 3 wherein each main electrode has a flat surface portion for contacting the other main electrode, and tapered surface portions at the periphery of said flat surface portion tapering away from the other main electrode.

5. A vacuum switch as set forth in any one of claims 1, 2, or 3, wherein the main electrode and highly conductive member of each of said stationary and movable electrodes are joined to each other by compression molding of a mixed powder containing at least 10% of a low melting point metal as a material for said main electrode, onto a copper base as a material for said highly conductive member.

6. A vacuum switch as set forth in any one of claims 1, 2, or 3, wherein the auxiliary electrode and highly conductive member of each of said stationary and movable electrodes are joined to each other by compression molding of a mixed powder containing at least 10% of a low melting point metal as a material for said auxiliary electrode, onto a copper base as a material for said highly conductive member.

7. A vacuum switch as set forth in any one of claims 1, 2, or 3, wherein materials for the main electrode, auxiliary electrode, and highly conductive member respectively, are selected from the group consisting of Cu-20CR-Bi, Cu-(10-60) Cr and 99.9Cu;

$CuCrBi_2O_3$, CuCr and Cu;

AgWC, CuCr and Cu; and

CuC, CuCr and Cu.

* * * * *

UNITED STATES PATENT AND TRADEMARK OFFICE

CERTIFICATE OF CORRECTION

PATENT NO. : 5,059,752

DATED : Oct. 22, 1991

INVENTOR(S) : Koichi Inagaki

It is certified that error appears in the above-identified patent and that said Letters Patent is hereby corrected as shown below:

Column 1, delete lines 4-9;
line 19, " A-A' " should be -- 2-2 --;
line 44, after "moving" delete the comma ",".

Column 3, line 32, "8ba" should be --8b and--;
line 32, "denotes" should be --denote--;
line 39, "Cu-20-Cr-Bi" should be --Cu-20Cr-Bi--;
line 56, "having" should be --being--;
line 66, delete "tube".

Column 4, line 28, delete "tube";
line 34, delete "As";
line 68, before "outer" insert --Therefore it is advantageous to have--.

Column 5, line 2, delete "should be formed of the" and insert after "8b" --formed of this Cu-Cr alloy.--;
line 18, "7b, 8b" should be --7h, 8h--.

UNITED STATES PATENT AND TRADEMARK OFFICE

CERTIFICATE OF CORRECTION

PATENT NO. : 5,059,752

DATED : Oct. 22, 1991

INVENTOR(S) : Koichi Inagaki

It is certified that error appears in the above-identified patent and that said Letters Patent is hereby corrected as shown below:

Column 6, line 44, "Cu-20CR-Bi" should be --Cu-20Cr-Bi-- and "Cu-(10-60) Cr" should be --Cu-(10-60)Cr--.

Signed and Sealed this

Fourteenth Day of December, 1993

*Attest:*

*Attesting Officer*

Bruce Lehman

BRUCE LEHMAN

*Commissioner of Patents and Trademarks*